US006435706B1

(12) United States Patent
Bertolotti et al.

(10) Patent No.: US 6,435,706 B1
(45) Date of Patent: Aug. 20, 2002

(54) STIRRING A MEDIUM BY MEANS OF A MAGNETIC STIRRER WHILE CHECKING THE MAGNETIC DRIVE, ASSOCIATED APPARATUS

(75) Inventors: Gérard Bertolotti, Montreuil; Bernard Defontaine, Maurepas, both of (FR)

(73) Assignee: Compagnie Generale des Matieres Nuclearies, Velizy Villacoublay (FR)

( * ) Notice: Subject to any disclaimer, the term of this patent is extended or adjusted under 35 U.S.C. 154(b) by 36 days.

(21) Appl. No.: 09/621,015

(22) Filed: Jul. 21, 2000

(30) Foreign Application Priority Data

Jul. 22, 1999 (FR) ..... 99 09509

(51) Int. Cl.[7] ..... B01F 13/08
(52) U.S. Cl. ..... 366/141
(58) Field of Search ..... 366/273, 274, 366/141, 331; 417/420; 416/3; 73/54.23, 54.28, 54.35

(56) References Cited

U.S. PATENT DOCUMENTS 4,991,973 A * 2/1991 Maaz et al. ..... 366/274
5,261,742 A * 11/1993 Lockhart ..... 366/273
5,533,800 A * 7/1996 Stiegelmann et al. ..... 366/274
5,647,974 A * 7/1997 Shim et al. ..... 210/103
5,694,341 A * 12/1997 Song ..... 364/567
6,065,865 A * 5/2000 Eyraud et al. ..... 366/273

FOREIGN PATENT DOCUMENTS

| | | | |
|---|---|---|---|
| DE | 31 02 661 A1 | | 11/1982 |
| DE | 33 22 409 A1 | | 1/1985 |
| DE | 41 34 725 | * | 4/1993 |
| DE | 42 01 693 C1 | | 4/1993 |
| EP | 0 548 490 | * | 6/1993 |
| EP | 0 589 093 | * | 3/1994 |
| JP | 63151342 | | 6/1988 |
| JP | 02184736 | | 7/1990 |
| JP | 03000122 | | 1/1991 |

* cited by examiner

*Primary Examiner*—Tony G. Soohoo
(74) *Attorney, Agent, or Firm*—Cohen, Pontani, Lieberman & Pavane

(57) ABSTRACT

The present invention relates to a method of stirring a medium contained in a receptacle having at least one non-magnetic wall, the medium being stirred by means of a magnetic stirrer comprising a magnetic moving body placed in said medium on one side of said non-magnetic wall(s) and drive equipment for rotating said magnetic moving body disposed outside said medium on the other side of said non-magnetic wall. In characteristic manner, the method is implemented while continuously monitoring the magnitude of the magnetic attraction force between said magnetic object and the drive equipment therefor. The present invention also provides apparatus suitable for implementing said method.

5 Claims, 1 Drawing Sheet

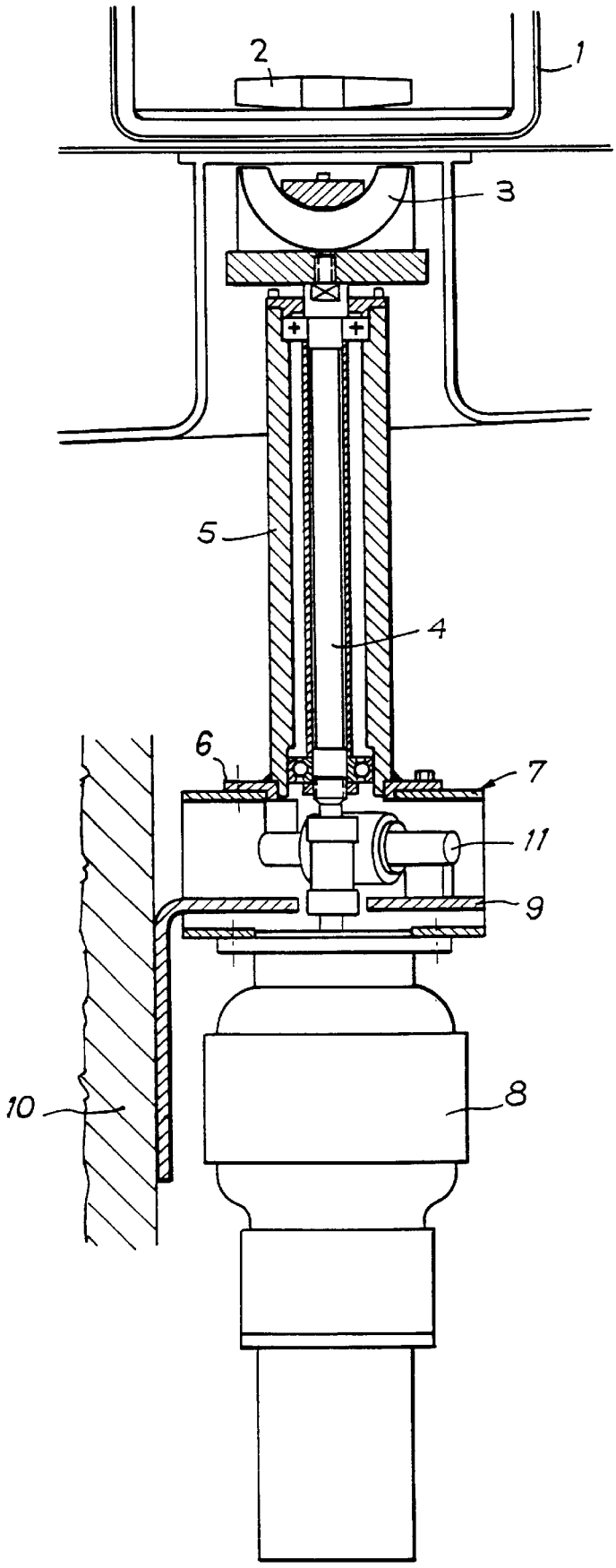
1
2
3
4
5
6
7
8
9
10
11

STIRRING A MEDIUM BY MEANS OF A MAGNETIC STIRRER WHILE CHECKING THE MAGNETIC DRIVE, ASSOCIATED APPARATUS

The present invention relates to stirring a medium by means of a magnetic stirrer, while checking the magnetic drive, and it also relates to the associated apparatus. More precisely, the invention relates to a method of stirring by means of a magnetic stirrer having a magnetic moving body, the method being implemented while monitoring the rotary drive of said moving body, and the invention also provides the associated stirring apparatus including said magnetic stirrer.

BACKGROUND OF THE INVENTION

Magnetic stirrers have been known and used for very many years for stirring a medium, generally a liquid or a suspension, in a receptacle having at least one non-magnetic wall. Such stirrers comprise a rotary magnet or electromagnet located outside said receptacle, and acting on a magnetic object (generally a bar or a helix) which is disposed inside the receptacle; said magnet or electromagnet and said magnetic object act on opposite sides of said non-magnetic wall. On being rotated, said magnet or electromagnet drives said magnetic object.

Although stirring sometimes provides little more than a small improvement, in general it is necessary or even absolutely indispensable, in particular for safety reasons.

Thus, it will readily be understood that, it is appropriate:

- to be able at all times to check that the magnetic object situated inside the receptacle is indeed being rotated by the magnet or the electromagnet on the outside;
- to be able to detect when said object ceases to be driven; and
- in other words to be able to verify at all times that the magnetic stirrer is operating properly.

Such checks, detections, or verifications are generally performed by an operator looking at the magnetic object. Unfortunately, this is not always possible. In particular, it is impossible when the medium to be stirred is opaque and/or the receptacle containing the medium to be stirred has walls that are opaque, . . . In such contexts, implementing such checks, detections, or verifications gives rise to a genuine technical problem.

The Applicant has developed the present invention with reference to that technical problem. Said invention, in both its method and its apparatus aspects, can be thought of as an improvement to the prior art magnetic stirring technique. According to the invention, said prior art technique is improved in that it is associated with checking of the magnetic drive (of said magnetic object by said magnet or electromagnet).

Said checking of the invention is based on continuously monitoring the magnitude of the magnetic attraction force (the force that results from the magnetic field that is created), and in a preferred implementation, on continuously monitoring a mechanical effect of the magnetic field.

It is not based on monitoring said magnetic field directly. Prior art techniques based on such direct monitoring of the magnetic field are described in particular in documents DE-A-33 22 409, DE-A-42 01 693, and DE-A-31 02 661.

OBJECTS AND SUMMARY OF THE INVENTION

In a first aspect, the present invention thus provides a method of stirring a medium contained in a receptacle having at least one non-magnetic wall, the medium being stirred by means of a magnetic stirrer comprising a magnetic moving body placed in said medium on one side of said non-magnetic wall(s) and drive equipment for rotating said magnetic moving body disposed outside said medium on the other side of said non-magnetic wall. In this respect, said method is a magnetic stirring method in accordance with the prior art. In a manner characteristic of the invention, said method is implemented while continuously monitoring the magnitude of the magnetic attraction force between said magnetic object and its drive equipment.

The monitoring of said magnitude can include quantizing it. Nevertheless, such quantizing is not essential in any way. In the context of said monitoring, all that is required is the ability to detect any significant variation of said magnitude, where such variation is indicative, initially, of the magnetic moving body beginning to lose coupling, and subsequently of it losing coupling completely.

Such continuous monitoring makes it possible to perform the abovementioned checks, detections, and verifications, and to do so "blind". It can be implemented in various ways.

In a preferred variant, said monitoring consists in monitoring the apparent weight of the equipment for rotating the magnetic moving body. Such a variant is implemented under the following conditions:

- the stirred medium is contained in a receptacle whose bottom wall (at least) is non-magnetic;
- the magnetic moving body is disposed on said bottom wall (inside said receptacle); and
- the equipment for driving said moving body (which includes a magnet or an electromagnet) is disposed vertically beneath said wall.

Said apparent weight consists in said drive equipment's own weight minus the magnetic attraction force (exerted by the magnet or the electromagnet). When uncoupling occurs, said apparent weight increases so as to tend towards the value of the equipment's full weight.

To monitor said apparent weight, provision is generally made to suspend said drive equipment from a fixed structure by means of a flexible system. The device used can exist in various embodiments. One embodiment is described in general terms below in the present text, and then in greater detail with reference to the accompanying figure.

In the context of this preferred variant, the magnitude of the magnetic attraction force between the magnetic object and its drive equipment is monitored indirectly by monitoring the apparent weight of said drive equipment. In other variants, monitoring can be performed directly or indirectly. Thus, for example, it is possible to monitor said magnitude directly by means of a dynamometer or any equivalent means. Said dynamometer or equivalent means connects the end of the drive equipment furthest from the magnetic object to a fixed structure, said drive equipment being disposed along a horizontal axis in a device canceling its weight. It is also quite possible to design intermediate systems in which such a dynamometer or equivalent means is to be found connecting the end of the drive equipment to a fixed structure, said drive equipment being disposed along an inclined axis in a device canceling a part of its weight.

In a second aspect, the present invention also provides apparatus for stirring a medium contained in a receptacle having at least one non-magnetic wall, the apparatus being of the magnetic stirrer type comprising a magnetic moving body disposed in said medium on one side of said non-magnetic wall(s) and drive equipment for rotating said magnetic body disposed outside said medium on the other side of said non-magnetic wall. In this respect, said apparatus is a magnetic stirrer in accordance with the prior art. In a manner characteristic of the invention, said drive equipment for driving said apparatus is secured to means capable of detecting any variation in the magnitude of the magnetic attraction force between said magnetic object and its drive equipment.

Said means make it possible to monitor, in the meaning of the invention, to carry out the above-mentioned checks, detections, and verifications. Said means can be implemented in various ways.

Thus, in the preferred implementation of the method of the invention as described above, said means are capable of detecting any variation in the apparent weight of the drive equipment.

In the context of this variant, it has been stated that:

the receptacle containing the medium to be stirred has (at least) a bottom wall that is not magnetic;

the magnetic moving body is disposed on said bottom wall of said receptacle; and said drive equipment for driving said moving body is disposed vertically beneath said wall.

In a particularly preferred manner, in the context of this variant, said drive equipment comprises:

a rotary magnet (or electromagnet);

a drive motor for rotating said magnet;

a drive shaft connecting said motor to said magnet; and a stationary tube surrounding said drive shaft; and it is supported by at least one force sensor suitable for detecting any variation in its apparent weight, via an element secured to said stationary tube.

The term "magnet" in the present specification and the accompanying claims covers both a permanent magnet and an electromagnet. The use of a permanent magnet can be easier to manage, but that does not exclude the use of an electromagnet. In any event, the electrical power supply to said electromagnet should not interfere with implementing the method of the invention.

The or each force sensor is one of the elements of the flexible system mentioned above in the present specification, which flexible system serves to connect the drive equipment to a fixed structure, which drive equipment is suspended on a vertical axis.

Advantageously, said force sensor(s) consist(s) in one or more strain gauges operating in bending.

In a particularly preferred variant, three force sensors are disposed (advantageously symmetrically) about the drive shaft, advantageously in the form of three strain gauges operating in bending.

Such an embodiment of the stirring apparatus of the invention incorporating means for checking magnetic drive, is described in greater detail below with reference to the sole accompanying figure.

It is recalled, incidentally, that apparatuses of the invention can exist in other embodiments, and in particular can include a dynamometer as means for checking magnetic drive directly (where the dynamometer is attached to the end of a drive equipment organized on a horizontal axis in a device for supporting the weight of the equipment).

BRIEF DESCRIPTION OF THE DRAWING

The said accompanying FIGURE is a longitudinal section of an improved magnetic stirrer of the invention, in which its drive equipment is secured to means capable of detecting any variation in the magnitude of the magnetic attraction force between itself and the magnetic object.

MORE DETAILED DESCRIPTION

In said FIGURE, the following are shown more particularly:

at 1, the supported receptacle in which there is the liquid or the suspension or more generally the medium which is to be stirred;

at 2, the magnetic moving body for stirring, or magnetic bar;

at 3, a permanent magnet in the form of a horse-shoe; the size of this magnet matching that of said bar 2;

at 4, the drive shaft for rotating said magnet 3; said shaft 4 lies on the axis of a stationary tube 5;

at 6, a link part serving to support said fixed tube 5 on a box 7 of rectangular section, and having facing openings in two of its horizontal walls, with said drive shaft 4 passing therethrough;

at 8, the motor which rotates said shaft 4;

at 9, a bracket having an opening in the middle of its horizontal part through which said shaft 4 of the motor 8 passes; the bracket 9 is secured via its vertical part to a structure 10; and at 11, a force sensor disposed around said shaft 4, between the top horizontal wall of the box 7 and the horizontal portion of said bracket 9.

Advantageously, three such sensors are used, e.g. three strain gauges operating in bending.

Said sensor(s) is/are suitable for measuring the force exerted thereon by the top horizontal wall of the box 7 which supports the entire drive equipment for driving the bar 2, as constituted by the magnet 3, the shaft 4, the stationary tube 5, the link part 6, the box 7, and the motor 8.

When the magnet 3 rotates the bar 2 normally, the force exerted on the sensor(s) 11 is equal to the weight of said drive equipment (3+4+5+6+7+8) minus the force of attraction exerted by said bar 2 on the magnet 3. The resultant force constitutes the apparent weight of said drive equipment (3+4+5+6+7+8).

When the magnet 3 is rotating but is no longer driving said bar 2 (because said bar has become uncoupled), it is observed that said drive equipment (3+4+5+6+7+8) exerts a greater force on the sensor(s) 11. The force then exerted corresponds substantially to the real weight of the drive equipment. By detecting this "change of weight" of the drive equipment (3+4+5+6+7+8) with the sensor(s) 11, it is possible to be informed when the magnetic bar 2 is not being driven by the magnet 3.

The following can be also be stated, by way of example.

The invention has been implemented using apparatuses of the type shown in the accompanying figure under the following conditions.

The receptacle 1 was constituted by a glass beaker contained in a stainless steel receptacle. The magnetic bars 2 had lengths of 12 cm to 15 cm. The magnet 3 was in the form of a parallelepiped.

For drive equipment (3+4+5+6+7+8) having a real weight lying in the range 10 kg to 20 kg, additional forces corresponding to a weight of about 200 g to 300 g were measured whenever the bar 2 became uncoupled.

What is claimed is:

1. A method of stirring a medium contained in a receptacle having a non-magnetic bottom wall, the medium being stirred by means of a magnetic stirrer comprising a magnetic moving body disposed in said medium on one side of said bottom wall and drive equipment for rotating said moving body disposed on the other side of said bottom wall, the method comprising the step of continuously monitoring the magnitude of the magnetic attraction force between said magnetic moving body and said drive equipment by continuously monitoring the apparent weight of said drive equipment and determining a variation of the magnitude of said attraction force by determining the variation of said apparent weight.

2. An apparatus for stirring a medium contained in a receptacle having a non-magnetic bottom wall, the apparatus being of the magnetic stirrer type comprising a magnetic moving body disposed in said medium on one side of said bottom wall and drive equipment for rotating said moving body disposed on the other side of said bottom wall, wherein said drive equipment is secured to means suitable for determining any variation in the magnitude of the magnetic attraction force between said magnetic stirrer and said drive equipment, said means including sensing means capable of detecting any variation in the apparent weight of the said drive equipment.

3. The stirring apparatus according to claim 2, wherein said drive equipment comprises:

a rotary magnet;

a drive motor for rotating said magnet;

a drive shaft connecting said motor to said magnet; and a stationary tube surrounding said drive shaft;

and wherein said drive equipment is supported by at least one force sensor suitable for detecting any variation in its apparent weight via an element secured to said stationary tube.

4. The stirring apparatus according to claim 3, wherein said force sensor is a strain gauge operating in bending.

5. The stirring apparatus according to claim 3, wherein three force sensors are disposed around said drive shaft.

* * * * *